US011819083B2

(12) United States Patent
Gilbert

(10) Patent No.: US 11,819,083 B2
(45) Date of Patent: Nov. 21, 2023

(54) HAT WITH IMPROVED COMFORT

(71) Applicant: HAPPENED BY CHANCE PRODUCTIONS, LLC, Bee Cave, TX (US)

(72) Inventor: Chance M. Gilbert, Bee Cave, TX (US)

(73) Assignee: Happened By Chance Productions, LLC, Austin, TX (US)

( * ) Notice: Subject to any disclaimer, the term of this patent is extended or adjusted under 35 U.S.C. 154(b) by 0 days.

(21) Appl. No.: 17/855,547

(22) Filed: Jun. 30, 2022

(65) Prior Publication Data

US 2023/0119878 A1 Apr. 20, 2023

Related U.S. Application Data

(60) Provisional application No. 63/262,769, filed on Oct. 20, 2021.

(51) Int. Cl.
*A42C 5/02* (2006.01)
*A42B 1/22* (2006.01)

(52) U.S. Cl.
CPC . *A42C 5/02* (2013.01); *A42B 1/22* (2013.01)

(58) Field of Classification Search
CPC ..... A42B 1/225; A42B 1/22; A42B 1/0182; A42B 1/0189; A42B 1/02; A42B 1/0181; A42B 1/018; A42B 1/04; A42B 7/00; A42B 5/04; A42C 5/02; A42C 5/00; Y10T 24/45958; A44B 13/0023; A44B 13/0052; A44B 17/0058; A44B 17/0064; A44B 17/0029
USPC ..... 2/195.1, 195.2, 195.4; 24/697.1, 575.1, 24/587.12
See application file for complete search history.

(56) References Cited

U.S. PATENT DOCUMENTS 2,684,485 A * 7/1954 Rossman ..... A41F 1/008 252/301.6 F
2,869,137 A * 1/1959 Scherz ..... A42B 1/22 2/195.4
4,481,681 A * 11/1984 Hankin ..... A41D 20/00 2/181
5,272,772 A * 12/1993 Hahn ..... A42B 1/22 2/418

(Continued)

FOREIGN PATENT DOCUMENTS

KR 20000013601 U * 7/2000
KR 20180063635 A * 6/2018

(Continued)

*Primary Examiner* — Amy Vanatta
(74) *Attorney, Agent, or Firm* — Dickinson Wright PLLC; Mark E. Scott

(57) ABSTRACT

Hat with improved comfort. One example is a hat comprising: a crown; a brim coupled to the crown and extending away from the crown; a notch defined by the crown, the notch defining a first intersection and second intersection; an adjustable closure comprising a snap member and eyelet member, the snap member defining an inside surface and a proximal end coupled to the crown at the first intersection, and the eyelet member defining a proximal end coupled to the crown at the second intersection; and a comfort material coupled to the inside surface of the snap member, the comfort material extends from the first intersection of the snap member to a distal end of the snap member.

15 Claims, 7 Drawing Sheets

(56) References Cited

U.S. PATENT DOCUMENTS

| | | | | | |
|---|---|---|---|---|---|
| 5,287,559 | A * | 2/1994 | Christiansen | A42B 1/248 | 2/209.13 |
| 5,546,605 | A * | 8/1996 | Mallardi | A42B 1/22 | 2/209.13 |
| 5,657,491 | A * | 8/1997 | Young | A42B 1/22 | 2/195.5 |
| 5,687,425 | A * | 11/1997 | Blosser | A42B 1/22 | 2/209.13 |
| 5,901,371 | A * | 5/1999 | Lee | A42B 1/0185 | 2/172 |
| 6,006,362 | A * | 12/1999 | Walsh | A42B 1/248 | 2/181.2 |
| 6,446,266 | B1 * | 9/2002 | Park | A42B 1/248 | 2/175.1 |
| 9,763,486 | B2 * | 9/2017 | Lacy | A42B 1/22 | |
| 2021/0227915 | A1 * | 7/2021 | Leatherman | A42B 1/22 | |

FOREIGN PATENT DOCUMENTS

| | | | | |
|---|---|---|---|---|
| KR | 102273182 | B1 * | 7/2021 | A42B 1/22 |
| WO | WO-2018158623 | A1 * | 9/2018 | A42B 1/22 |

* cited by examiner

HAT WITH IMPROVED COMFORT

CROSS-REFERENCE TO RELATED APPLICATIONS

This application claims the benefit of U.S. provisional application No. 63/262,769 filed Oct. 20, 2021 titled "Hat with Improved Comfort." The provisional application is incorporated by reference herein as if reproduced in full below.

BACKGROUND

Hats, particularly hats in the style of baseball hats, are ubiquitous in modern culture. While hats may be primarily used to shade the eyes and cover the head of the wearer, in some cases a hat's purpose has more to do with prevailing fashion than any utilitarian features, particularly in the case of baseball hats.

In many cases, baseball hats have an adjustable closure such that the baseball hat can be sized to fit any number of people. Depending on how the baseball hat is worn, the adjustable closure may be uncomfortable.

BRIEF DESCRIPTION OF THE DRAWINGS

For a detailed description of example embodiments, reference will now be made to the accompanying drawings in which.

DEFINITIONS

Various terms are used to refer to particular system components. Different companies may refer to a component by different names—this document does not intend to distinguish between components that differ in name but have the same function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various examples are directed to a hat with improved comfort. More particularly, various examples are directed to a hat having a snap system as the adjustable closure. Because adjustable closures may be based on a snap arrangement, and further because the adjustable closure resides at what is sometimes considered the "back" of the hat, the adjustable closure may be referred to as a "snap-back" arrangement. In various examples, the inside surface of the adjustable closure includes a comfort material such that, in effect, a sweatband defined on the inside surface of the crown extends at least partially across the adjustable closure. The comfort material may make wearing the hat more comfortable, particularly when the hat is worn with the brim covering the wearer's neck rather than shading the wearer's eyes.

Figure 1:
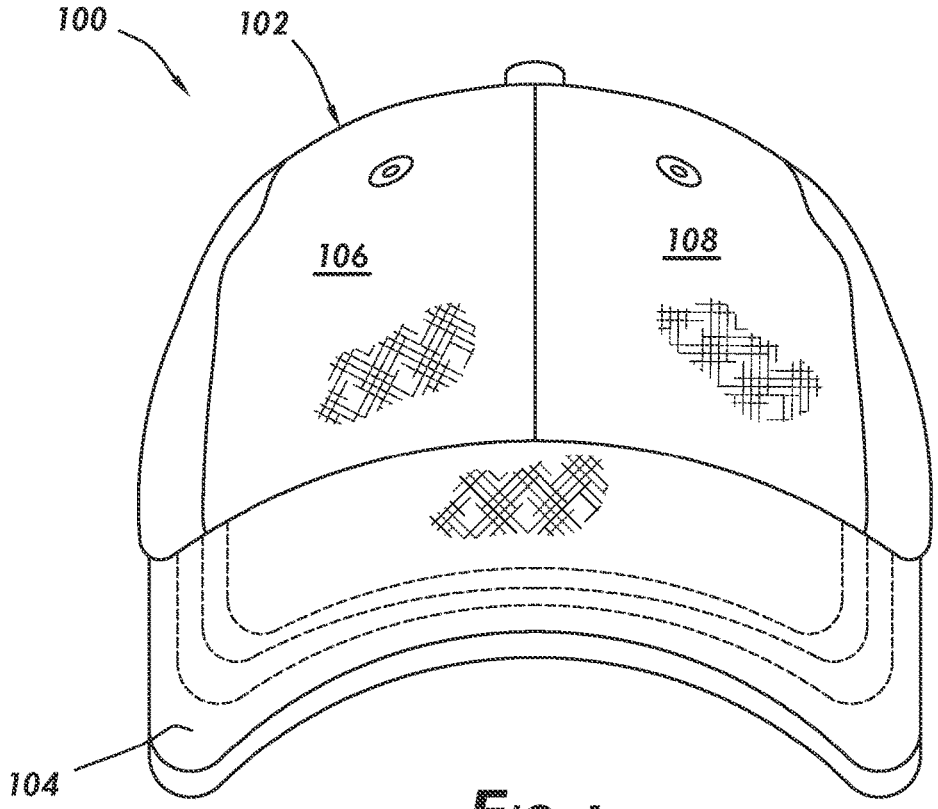
FIG. 1 shows a front elevation view of an example hat.

FIG. 1 shows a front elevation view of an example hat. In particular, FIG. 1 shows a hat 100 comprising a dome or crown 102 coupled to a shade or brim 104. The crown 102 may be constructed from several triangular shaped members or panels, such as panel 106 and panel 108. In some cases, the panels 106 and 108 may be associated with a buckram designed to hold the panels upright, such as to more prominently display a logo. However, not all hats include a buckram. Moreover, the brim 104 is shown to define a curvature, but in other cases the brim may be designed, constructed, and attached to the crown 102 in such a way that the brim is flat or almost flat.

Figure 2:
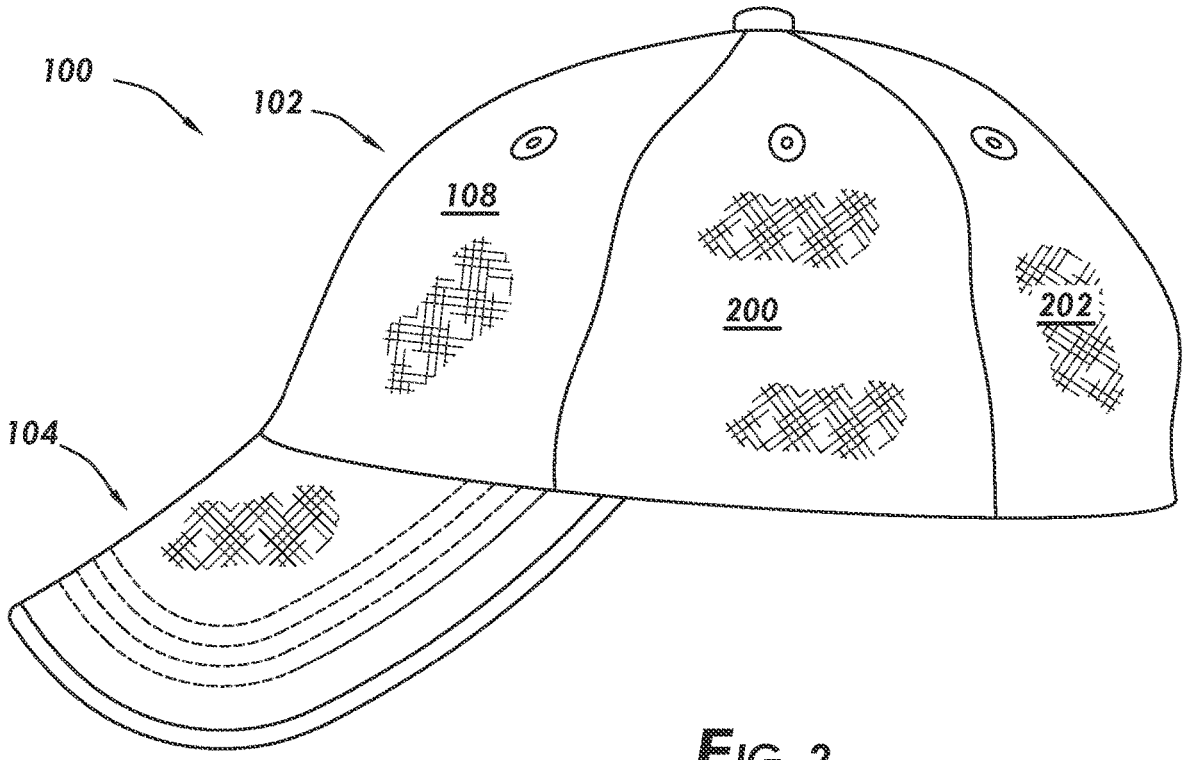
FIG. 2 shows a side elevation view of the example hat.

FIG. 2 shows a side elevation view of the example hat. In particular, visible in FIG. 2 is the crown 102 attached to the brim 104. The panel 108 is visible in FIG. 2, along with additional panels 200 and 202. FIG. 2 better shows that the panels (e.g., panels 108, 200, and 202) are coupled together (e.g., stitched or sewn) in such a way as to create the crown 102.

Figure 3:
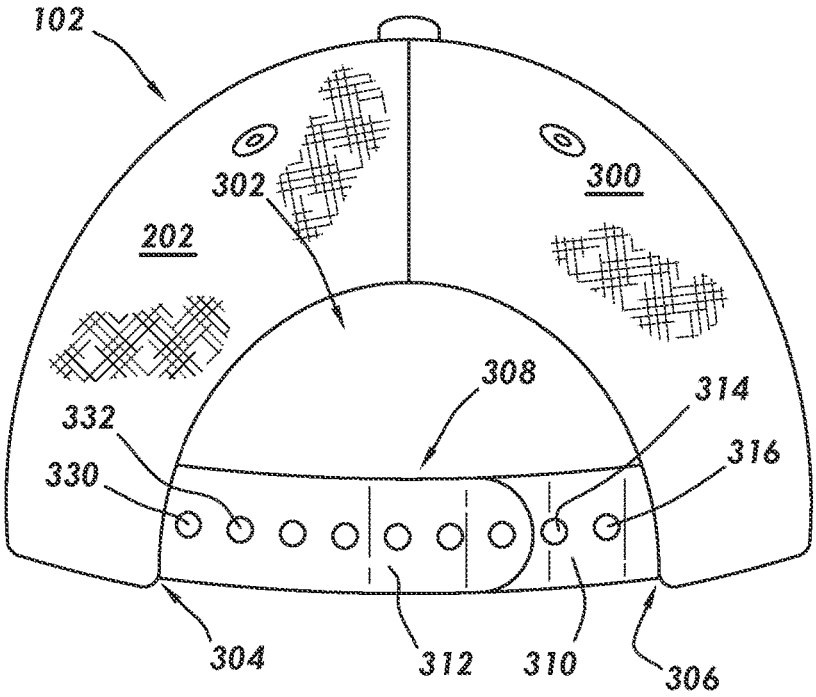
FIG. 3 shows a back elevation view of the example hat.

FIG. 3 shows a back elevation view of the example hat. Visible in FIG. 3 is the panel 202 and an additional panel 300. The panels 202 and 300, when coupled together as part of the crown 102, define a notch 302. In example hats the notch 302 defined by the crown 102 is disposed opposite the brim 104 (FIG. 1), but such is not strictly required. The example notch 302 defines an arch or curve with a first intersection 304 and second intersection 306. As will become more clear based on the description below, the first intersection 304 is an intersection with an internal sweatband on an inside surface of the crown 102. Similarly, the second intersection 306 is an intersection with the internal sweatband on an inside surface of the crown 102. Stated otherwise, the internal sweatband runs along the inside perimeter or inside surface of the crown 102 circumferentially from the first intersection 304 to the second intersection 305, including spanning the locations where the brim 104 (FIG. 1) is coupled to the crown 102. The purpose of the notch is to accommodate different size settings for the hat, and in some cases to enable a wearer's ponytail to extend through the notch.

Still referring to FIG. 3, the hat further comprises an adjustable closure 308 in the example form of snap member 310 and an eyelet member 312. The example snap member 310 defines a proximal end coupled to the crown 102 at the second intersection 306. The example snap member 310 defines a plurality of snaps or protrusions (e.g., protrusions 314 and 316) that protrude from an outside surface of the snap member 310 and extend radially outward. The example snap member 310 further defines an inside surface, not visible in FIG. 3 but discussed in greater detail below.

The adjustable closure 308 further defines the eyelet member 312. The eyelet member 312 defines a proximal end coupled to the crown 102 at the first intersection 304. The example eyelet member 312 defines a plurality of through bores, apertures, or eyelets (e.g., eyelets 330 and 332). The eyelets extend through the eyelet member 126. The eyelets of the eyelet member 312 work in conjunction with the protrusions of the snap member 310 to enable adjusting the size of the hat. The greater the number of protrusions coupled within respective eyelets, the smaller the inside circumference of the crown 102 at the location of the sweatband.

Figure 4:
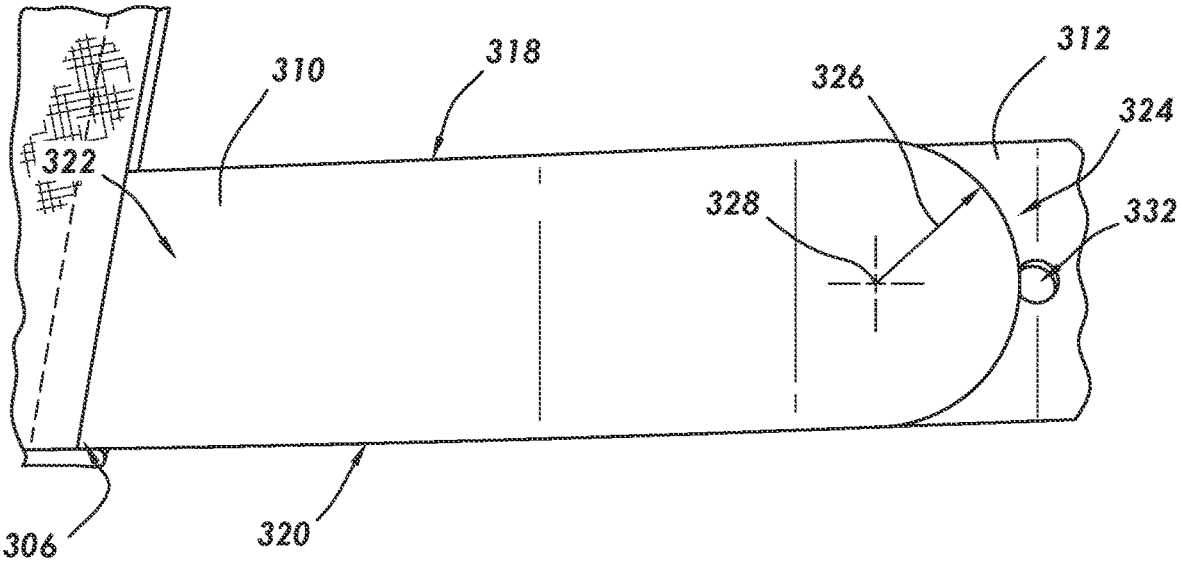
FIG. 4 shows a perspective view of an inside surface of related-art hat.

FIG. 4 shows a perspective view of an inside surface of a hat. In particular, visible in FIG. 4 is an inside surface of the snap member 310, along with a portion of the inside surface of the eyelet member 312. No protrusions are visible in the view of FIG. 4, and one unused eyelet 332 is visible. The example snap member 310 defines an upper long edge 318 and a lower long edge 320. The long edges are parallel to each other and also are parallel to the bottom edge of the crown 102. The proximal end 322 of the snap member 310 is disposed at the intersection 306, and the snap member 310 defines an opposite distal end 324. In example cases, the distal end 324 of the snap member 310 defines a curved edge or radius of curvature 326, and where the center 328 of the radius of curvature resides on or within the snap member 310.

Figure 5:
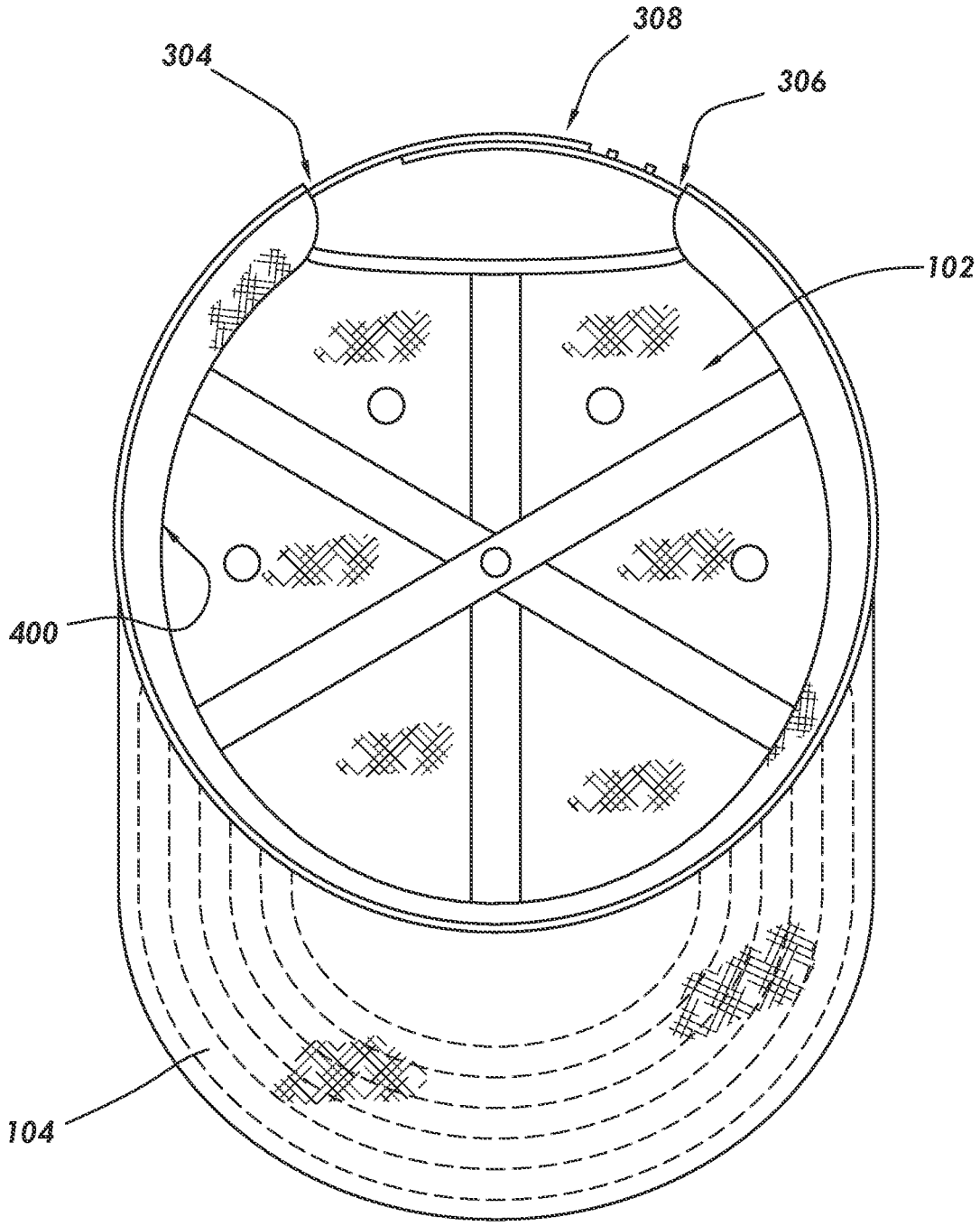
FIG. 5 shows a bottom view of an example hat.

FIG. 5 shows a bottom view of the example hat. In particular, visible in FIG. 5 is the brim 104 along with an inside surface of the crown 102. Also visible is the adjustable closure 308, though the individual members that form the adjustable closure are not specifically numbered. The inside surface of the crown includes a sweatband 400. The sweatband 400 may be defined by the material that makes up the crown 102, or the sweatband 400 may be constructed of different and distinct material coupled to the inside surface of the crown 102 in any suitable way (e.g., sewn or stitched). The sweatband 400 thus extends from the first intersection 304 circumferentially to the second intersection 306, including spanning the intersection of the brim 104 with the crown 102.

In related-art hats, when the hat is worn the adjustable closure directly abuts the wearer. More particularly, in related-art hats an inside surface of the snap member directly abuts the wearer, and depending on the adjusted size of the hat, a portion of the inside surface of the eyelet member may also directly abut the wearer. When a hat is worn with the brim covering the eyes, the adjustable closure abuts the back of the wearer's head, and in many cases the wearer's hair. However, when the hat is worn with the brim facing backward, the adjustable closure directly abuts the wearer's forehead, which can become uncomfortable when worn for extended periods of time.

Various examples of this specification address, at least in part, the issues of the related-art hats by placement of a comfort material on the inside surface of the adjustable closure 308. More particularly, various examples are directed placing a comfort material on an inside surface of the snap member 310. The comfort material makes wearing the hat with adjustable closure on the wearer's forehead more comfortable, may absorb perspiration and/or moisture, and may reduce the chances of abrasions to the skin.

Figure 6:
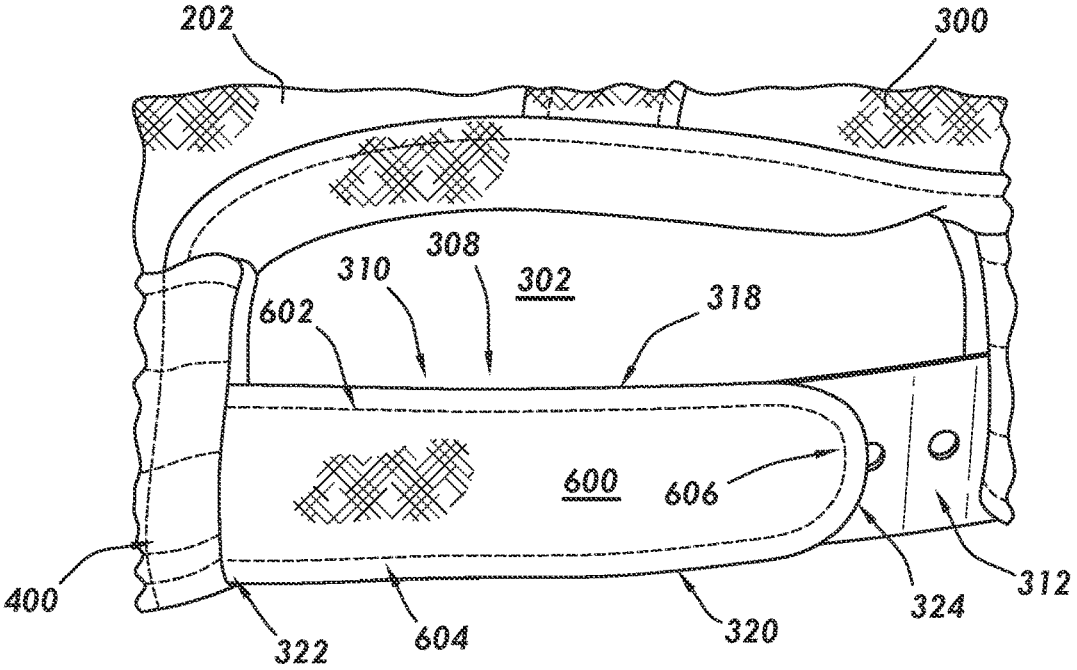
FIG. 6 shows perspective view of an inside surface of a hat in accordance with at least some embodiments.

FIG. 6 shows perspective view of an inside surface of an example hat. In particular, visible in FIG. 6 is the adjustable closure 308 including a portion of the inside surface of the eyelet member 312, and the notch 302 formed by the panels 202 and 300. Partially visible in FIG. 6 is the sweatband 400. The inside surface of the snap member 310 is covered with a comfort material 600. The example comfort material 600 extends from the proximal end 322 of the snap member 310 to the distal end 324 of the snap member 310. The comfort material 600 may be considered to extend the sweatband 400 to include the snap member 124. Stated otherwise, in the example system the comfort material 600 is distinct from, though contiguous with, the sweatband 400. However, the sweatband 400 and the comfort material 600 may be made of the same material. Thus, when the example hat is worn with the brim covering the wearer's neck, the comfort material 600 directly abuts the wearer's forehead. Given that in most cases the snap member 310 is a plastic material (as is the eyelet member 312), the comfort material 600 is likely more comfortable against the wearer's forehead than is the plastic material of the snap member 124.

The comfort material 600 may take any suitable form. For example, the comfort material 600 may be a fabric material, such as a textile that makes up the sweatband 400. In other cases, the comfort material 600 may be a material different than the sweatband 400, leather, leatherette, imitation leather, vegan leather, and/or pleather. Again, any suitable material may be used for the comfort material 600.

Still referring to FIG. 5, the comfort material 600 may be a strap of material, the strap of material defining a long dimension and a short dimension. The long dimension may be associated with a long edges 318 and 320 of the snap member 310, and the short dimension may be associated with the short dimension of the snap member 310. The strap of material defines a first long end and a second long edge, and in example cases the first and second long edges are folded under the strap of material. A first stitching 602 along the upper long edge holds the upper long edge of the strap material to the upper long edge 318 of the snap member 310. A second stitching 604 along the lower long edge holds the lower long edge of the strap material to the lower long edge 320 of the snap member 310. The example comfort material 600 thus creates folds along the long edges of the snap member 124.

In some cases, the folds terminate prior to the distal end 324 of the snap member 310, and thus the distal end of the strap member is coextensive with the distal end 324 of the snap member 310. However, in other cases the strap of material may be folded under along the distal end 324 of the snap member 310. In either case, the stitching, such as stitching 606, may run along parallel to the radius of curvature 326 (FIG. 3) defined by the snap member 310. Stated otherwise, the comfort material 600 may define folds along its long ends and around the curved distal end. While the example of FIG. 6 discusses the stitching 602, 604, and 606 as distinct, in some cases the stitching 602, 604, and 606 is a continuous set of stitching.

Figure 7:
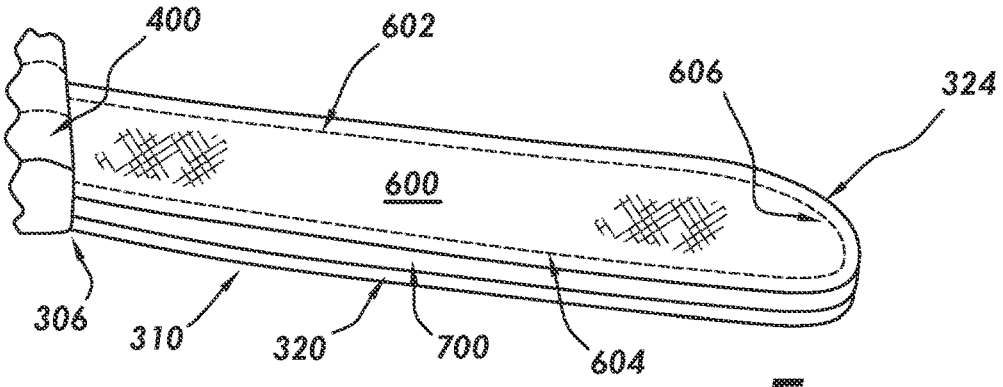
FIG. 7 shows a perspective view of the snap member and comfort material in accordance with at least some embodiments.

FIG. 7 shows a back perspective view of the snap member 310 and example comfort material 600. In particular, visible in FIG. 7 is the snap member 310 and the comfort material 600. Better shown in FIG. 7 is a fold 700 running along the lower long edge 320. Further visible in FIG. 7 is the stitching 602 disposed parallel to the upper long edge, the stitching 604 disposed parallel to the lower long edge 320, and the stitching 606 disposed parallel to the curved distal end 324. FIG. 7 further shows an example where the comfort material 600 is a distinct piece of material from the sweatband 400. During assembly of the overall hat, the snap member 310 with the affixed comfort material 600 may be inserted into the internal volume defined by the crown 102 (FIG. 1), and both the sweatband 400 and the snap member 310 (with affixed comfort material) may be sewn or stitched in place proximate to the intersection 306.

Figure 8:
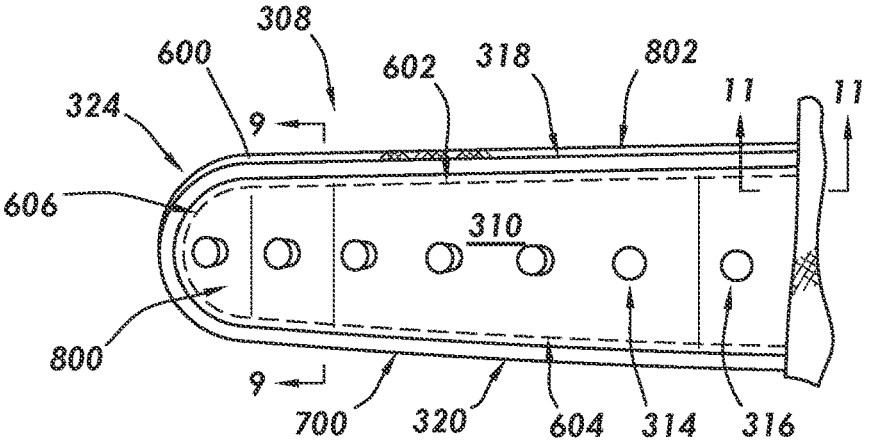
FIG. 8 shows a perspective view of an outside surface of the snap member in accordance with at least some embodiments.

FIG. 8 shows a perspective view of an outside surface of the snap member 310 of the example adjustable closure 308. In particular, visible in FIG. 8 is an outside surface 800 of the snap member 310, several protrusions (e.g., protrusions 314 and 316), the upper long edge 318, the lower long edge 320, and the distal end 324. Further visible in FIG. 8 is the opposite side of stitching 602, 604, and 606. That is to say, the stitching extends from the inner surface of the comfort material 600, through the folds, and through the snap member 310.

Further visible in FIG. 8 is a portion of the fold 700 on the lower side of the snap member 310, and a portion of the fold 802 on the upper side of the snap member 310. Thus, in example systems the width of the comfort material 600, taking into account the folds 700 and 802, and measured perpendicular to a line extending through at least two protrusions (e.g., protrusions 314 and 316), may be wider than the width of the snap member 310 between the upper long edge 318 and the lower long edge 320, and measured perpendicular to the line extending through the at least two protrusions. In one example case, the width may be between and including 0.5% and 5% wider than then snap member 310. In a particular example, the folds may overhang their respective edges by between and including 0.5 millimeter (mm) and 4 mm.

Figure 9:
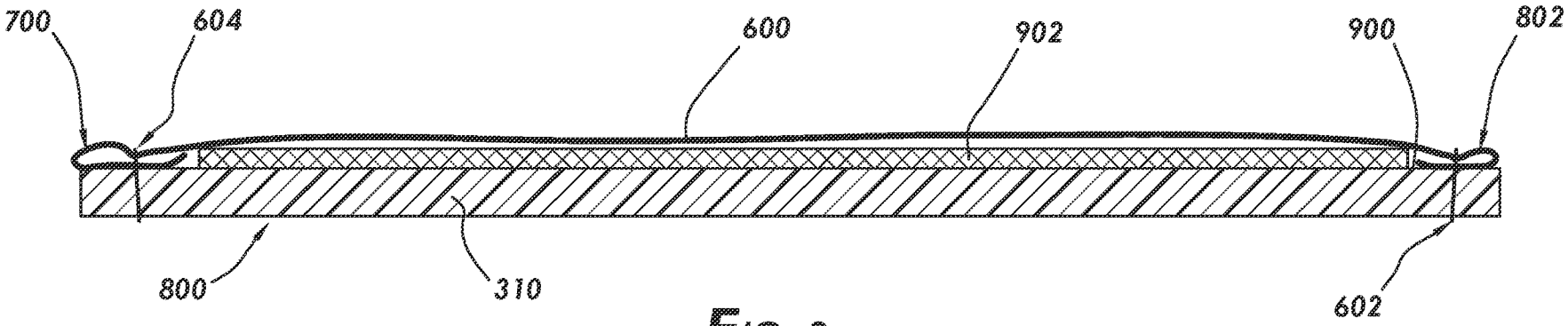
FIG. 9 shows a cross-sectional view of a snap member and attached comfort material taken substantially along line 9-9 of FIG. 8, and in accordance with a least some embodiments.

FIG. 9 shows a cross-sectional view of the example snap member 30 taken line 9-9 of FIG. 8. In particular, visible in FIG. 9 is the snap member 310. In the cross-section of FIG. 9, the cut does not cut through a protrusion (e.g., 314 or 316 (FIG. 3)), and thus no protrusions are visible. The snap member 310 thus defines the outside surface 800 (e.g., faces outwardly relatively a wearer's head) and an inside surface 900. The example inside surface 900 is covered by the comfort material 600. In particular, the comfort material 600 defines the fold 700 and the fold 802. The folds are held in place by example stitching 602 and 604. In some cases, an inner surface of the comfort material 600 may directly abut the inside surface 900 of the snap member 310. In other cases however, and as shown, the example hat comprises padding 902 disposed between the inside surface 900 of the strap member 310 and an inner surface of the comfort material 600. The padding may take any suitable form, such as a foam material, or another layer of fabric, to name a few.

Figure 10:
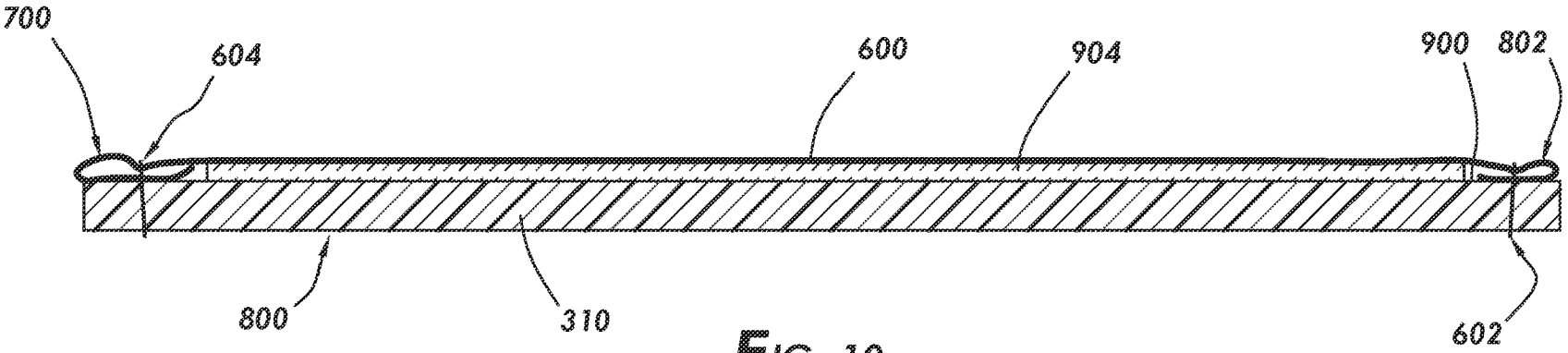
FIG. 10 shows a cross-sectional view of a snap member and attached comfort material taken substantially along line 9-9 of FIG. 8, and in accordance with a least some embodiments.

FIG. 10 shows a cross-sectional view of the example snap member 310 and attached comfort material 600 to show alternative arrangements, again with the cross-section taken along line 9-9 of FIG. 8. In FIG. 10 the cut does not cut through a protrusion (e.g., 314 or 316 (FIG. 3)), and thus no protrusions are visible. The example inside surface 900 is covered by the comfort material 600. In particular, the comfort material 600 again defines the first fold 700 on the first side and the second fold 802 on the second side opposite the first side. The example folds are held in place by example stitching 602 and 604. In the case of FIG. 10, however, the example hat comprises an adhesive 904 disposed between the inside surface 900 of the strap member 310 and an inner surface of the comfort material 600. The adhesive 904 may hold the comfort material 600 to the snap member 310. While FIG. 10 shows the adhesive 904 used with the folds 700 and 802 and stitching 602 and 604, in yet still other cases the folds and/stitching may be omitted when using the adhesive 904. In yet still further cases, example hats may have both the adhesive 904 and the padding 902.

Figure 11:
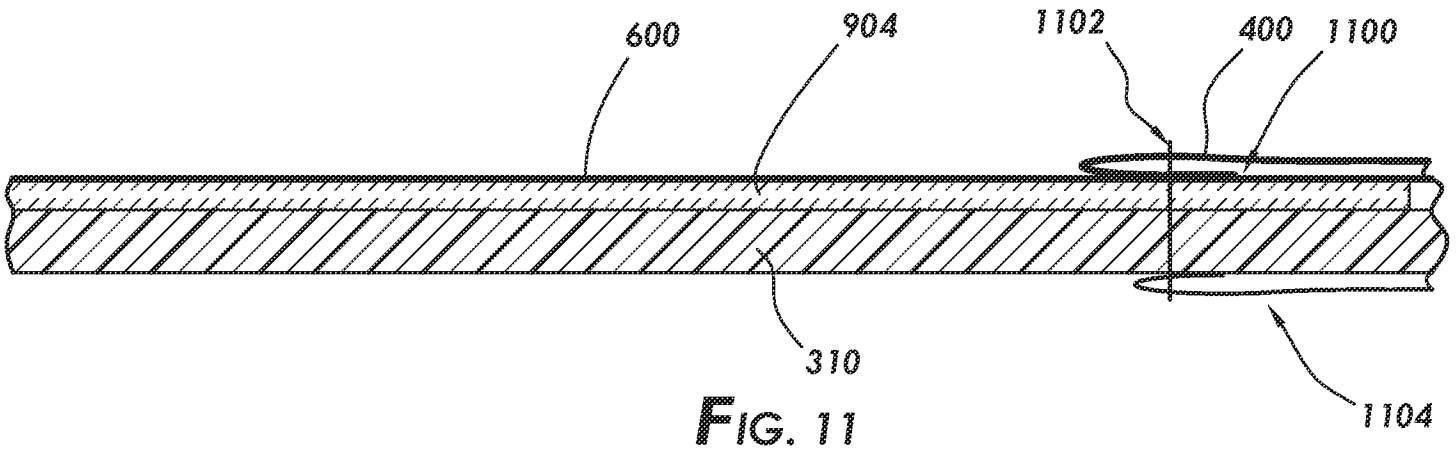
FIG. 11 shows a cross-sectional view of a snap member and attached comfort material take substantially along lines 11-11 of FIG. 8, and in accordance with at least some embodiments.

FIG. 11 shows a cross-sectional view of the example snap member 310 and attached comfort material 600, with the cross-section taken along line 11-11 of FIG. 8. In particular, visible in FIG. 11 is a portion of the snap member 310 comprising the comfort material 600. In the example case, the adhesive 904 is present between the snap member 310 and the comfort material 600, but in other cases the adhesive may be omitted, the adhesive 904 may be replaced with the padding 902 (FIG. 9), or the example system may have both the adhesive 904 and the padding 902. Further visible in FIG. 11 is a portion of the sweatband 400. In particular, in this example the sweatband 400 is a distinct material from the comfort material 600, but the comfort material 600 and the sweatband 400 are contiguous. Moreover, while the sweatband 400 is described as distinct, again the comfort material 600 and the sweatband 400 may be made of the same material. Thus, in the example shown the distal end 1100 of the sweatband 400 is folded under itself, and stitching 1102 may extend through the sweatband 400, comfort material 600 and the snap member 310. Moreover, the stitching 1102 may extend through the material 1104 that defines outer surface 1104 of the crown, such as netting material for summer hats, or a textile or leather product for winter hats.

Figure 12:
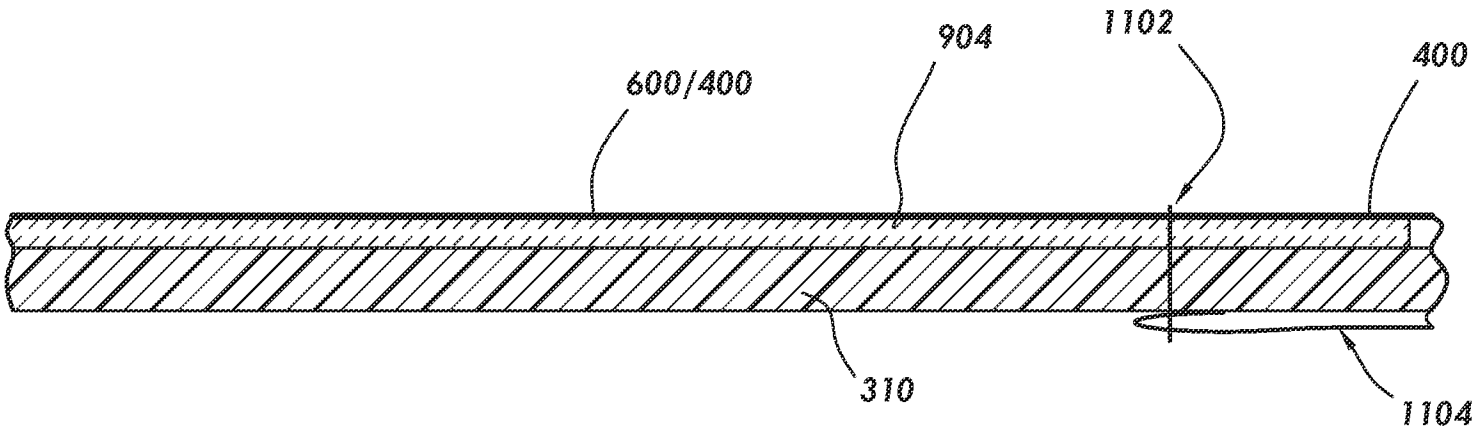
FIG. 12 shows a cross-sectional view of a snap member and attached comfort material in accordance with a least some embodiments.

FIG. 12 shows a cross-sectional view of the example snap member 310 and attached comfort material 600 in accordance with example embodiments. The cross-sectional view of FIG. 12 is similar to that of FIG. 11, but shows an alternative arrangement in which the sweatband 400 and comfort material 600 are a continuous piece of material. In particular, visible in FIG. 12 is a portion of the snap member 310. Again, the adhesive 904 is present, but in other cases the adhesive may be omitted, the adhesive 904 may be replaced with the padding 902 (FIG. 9), or the example system may have both the adhesive 904 and the padding 902. Further visible in FIG. 12 is the combined comfort material 600 and sweatband 400—hereafter just combined material 600/400. In particular, in this example the sweatband 400 extends past the stitching 1102 to further define the comfort material 600. As before, the stitching 1102 may extend through the material 1104 that defines outer surface 1104 of the crown, such as netting material for summer hats, or a textile or leather product for winter hats.

Figure 13:
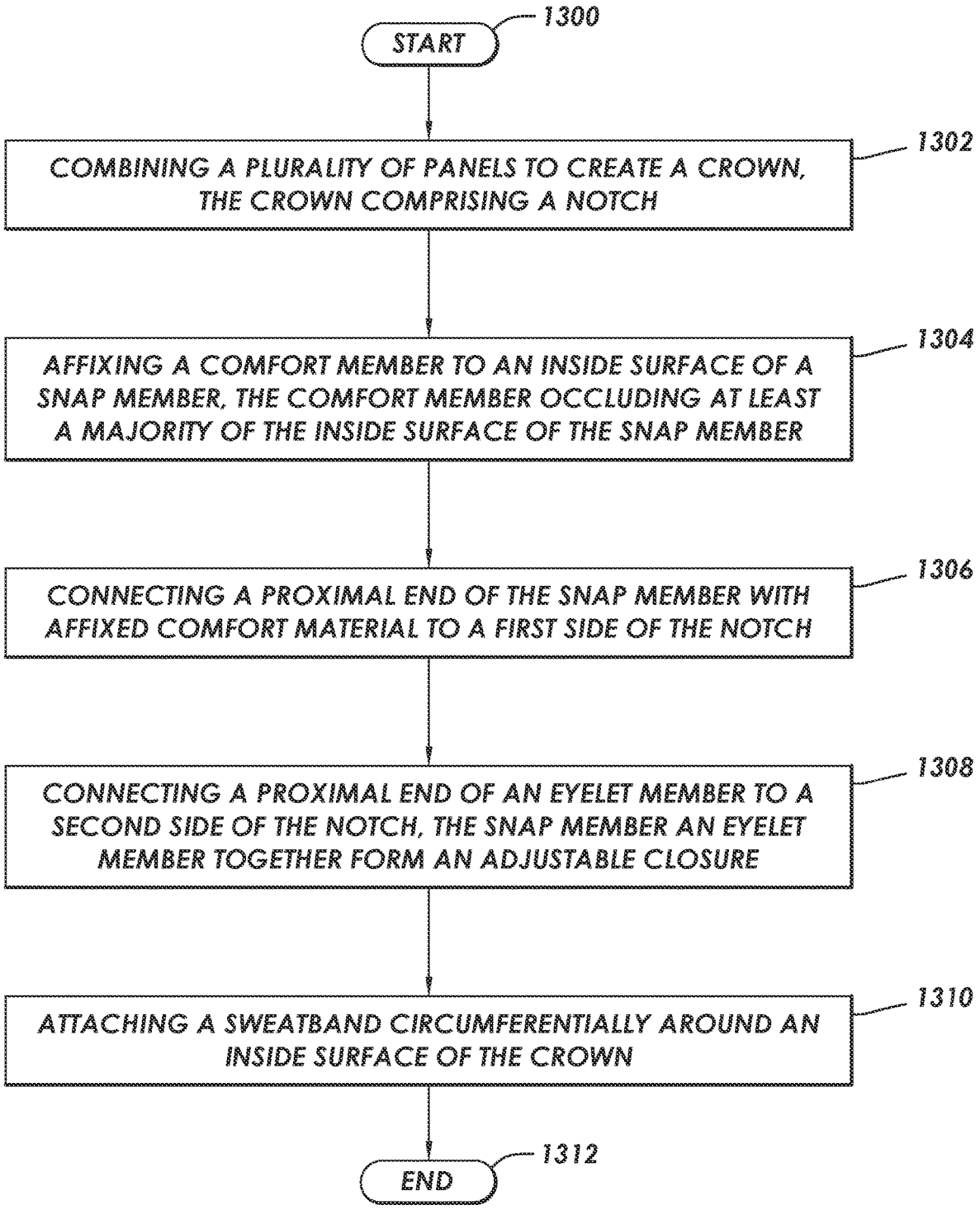
FIG. 13 shows a method in accordance with at least some embodiments.

FIG. 13 shows a method in accordance with at least some embodiments. In particular, the method starts (block 1300) and comprises: combining a plurality of panels to create a crown, the crown comprising a notch (block 1302); affixing a comfort member to an inside surface of a snap member, the comfort member occluding at least a majority of the inside surface of the snap member (block 1304); connecting a proximal end of the snap member with affixed comfort material to a first side of the notch (block 1306); connecting a proximal end of an eyelet member to a second side of the notch, the snap member and eyelet member together form an adjustable closure (block 1308); and attaching a sweatband circumferentially around an insider surface of the crown (block 1310). Thereafter, the method ends (block 1312), likely to be restarted with the next hat to be manufactured.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A hat comprising:

a crown;

a brim coupled to the crown and extending away from the crown;

a notch defined by the crown, the notch defining a first intersection and second intersection;

an adjustable closure comprising a snap member and eyelet member, the snap member defining an inside surface and a proximal end coupled to the crown at the first intersection, and the eyelet member defining a proximal end coupled to the crown at the second intersection; and a comfort material coupled to the inside surface of the snap member, the comfort material extends from the first intersection of the snap member to a distal end of the snap member;

a sweatband disposed on an inside surface of the crown from the first intersection circumferentially to the second intersection and spanning a location of the brim, and wherein the comfort material is distinct from sweatband, and the comfort material is affixed to the sweatband.

2. The hat of claim 1 wherein the comfort material is affixed to the sweatband by stitches proximate to the first intersection.

3. A hat comprising:

a crown;

a brim coupled to the crown and extending away from the crown;

a notch defined by the crown, the notch defining a first intersection and second intersection;

an adjustable closure comprising a snap member and eyelet member, the snap member defining an inside surface and a proximal end coupled to the crown at the first intersection, and the eyelet member defining a proximal end coupled to the crown at the second intersection; and a comfort material coupled to the inside surface of the snap member, the comfort material extends from the first intersection of the snap member to a distal end of the snap member;

wherein the snap member defines a distal end with a radius of curvature having a center, the center of the radius of curvature disposed on or within the snap member, and wherein the comfort material terminates coextensive with the radius of curvature.

4. The hat of claim 3 further comprising the comfort material comprises at least one selected from a group consisting of: textile; fabric; leather;

leatherette; imitation leather; vegan leather; and pleather.

5. A hat comprising:

a crown;

a brim coupled to the crown and extending away from the crown;

a notch defined by the crown, the notch defining a first intersection and second intersection;

an adjustable closure comprising a snap member and eyelet member, the snap member defining an inside surface and a proximal end coupled to the crown at the first intersection, and the eyelet member defining a proximal end coupled to the crown at the second intersection; and a comfort material coupled to the inside surface of the snap member, the comfort material extends from the first intersection of the snap member to a distal end of the snap member; the comfort material further comprises:

a strap of material defining a first long edge and a second long edge, the long edges folded under the strap of material;

first stitching along the first long edge holding the first long edge to a first long edge of the snap member; and second stitching along the second long edge holding the second long edge to a second long edge of the snap member.

6. The hat of claim 5 further comprising:

the snap member defines a distal end with a radius of curvature having a center, the center of the radius of curvature disposed on or within the snap member;

the strap of material defining a curved distal end; and third stitching along the curved distal end, the third stitching holds the curved distal end of the strap of material to the inside surface of the radius of curvature.

7. The hat of claim 5 further comprising an adhesive disposed between the inside surface of the snap member and the comfort material.

8. The hat of claim 5 further comprising padding disposed between the inside surface of the snap member and the comfort material.

9. The hat of claim 5 further comprising the notch being opposite the brim.

10. A method of manufacturing a hat, the method comprising:

combining a plurality of panels to create a crown, the crown comprising a notch;

affixing a comfort member to an inside surface of a snap member, the comfort member occluding at least a majority of the inside surface of the snap member, the affixing comprises stitching a first long edge of the comfort material along a first long edge of the snap member, stitching a second long edge of the comfort material along a second long edge of the snap member, and stitching a curved edge of the comfort material along a radius of curvature defined by a distal end of the snap member, connecting a proximal end of the snap member with affixed comfort material to a first side of the notch;

connecting a proximal end of an eyelet member to a second side of the notch, the snap member end eyelet member together form an adjustable closure; and attaching a sweatband circumferentially around an inside surface of the crown.

11. The method of claim 10 wherein affixing the comfort material further comprises affixing a continuous or contiguous portion of the sweatband to the inside surface of the snap member.

12. The method of claim 10 wherein affixing the comfort material further comprises affixing a strap material to the snap member, the strap material distinct from the sweatband.

13. A hat comprising:

a crown;

a brim coupled to the crown and extending away from the crown;

a notch defined by the crown, the notch defining a first intersection and second intersection, and the notch disposed on an opposite side of the crown from the brim;

a sweatband disposed on an inside surface of the crown from the first intersection circumferentially to the second intersection and spanning a location of the brim;

an adjustable closure comprising a snap portion and eyelet portion, the snap portion defining an inside surface and a proximal end coupled to the crown at the first intersection, and the eyelet portion defining a proximal end coupled to the crown at the second intersection;

a fabric coupled to the inside surface of the snap portion, the fabric extends from the first intersection of the snap portion to a distal end of the snap portion, and wherein the fabric is distinct from sweatband;

a first fold defined by the fabric, the first fold parallel to a first long edge of the snap portion;

a second fold defined by the fabric, the second fold parallel to a second long edge of the snap portion;

first stitching along the first long edge parallel to the first fold, the first stitching holds a first long edge of the fabric to the first long edge of the snap portion; and second stitching along the second long edge parallel to the second fold, the second stitching holds a second long edge of the fabric to the second long edge of the snap portion.

14. The hat of claim 13 further comprising an adhesive disposed between the inside surface of the snap portion and the fabric.

15. The hat of claim 13 further comprising padding disposed between the inside surface of the snap portion and the fabric.

* * * * *